US008129915B2

(12) United States Patent
Naruo

(10) Patent No.: US 8,129,915 B2
(45) Date of Patent: Mar. 6, 2012

(54) DISCHARGE LAMP OPERATING DEVICE, ILLUMINATION DEVICE AND LIQUID CRYSTAL DISPLAY DEVICE

(75) Inventor: Masahiro Naruo, Hirakata (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 332 days.

(21) Appl. No.: 12/663,596

(22) PCT Filed: Jun. 11, 2008

(86) PCT No.: PCT/JP2008/060637

§ 371 (c)(1),
(2), (4) Date: Dec. 8, 2009

(87) PCT Pub. No.: WO2008/156015

PCT Pub. Date: Dec. 24, 2008

(65) Prior Publication Data

US 2010/0176739 A1 Jul. 15, 2010

(30) Foreign Application Priority Data

Jun. 20, 2007 (JP) ..... 2007-162759

(51) Int. Cl.
*H05B 41/26* (2006.01)

(52) U.S. Cl. ..... 315/224; 315/244; 315/245; 315/209 R; 315/307; 315/DIG. 4

(58) Field of Classification Search ..... 315/224, 315/225, 244, 245, 276, 277, 287, 307, 209 R, 315/203, 200 R, DIG. 2, DIG. 4, DIG. 5, 315/DIG. 7

See application file for complete search history.

(56) References Cited

U.S. PATENT DOCUMENTS

| | | | | |
|---|---|---|---|---|
| 5,939,836 | A * | 8/1999 | Mita et al. | 315/224 |
| 6,339,299 | B1 * | 1/2002 | Wu et al. | 315/244 |
| 7,154,232 | B2 * | 12/2006 | Contenti et al. | 315/225 |
| 7,378,804 | B2 * | 5/2008 | Mitsuyasu et al. | 315/247 |
| 7,436,123 | B2 * | 10/2008 | Hamamoto et al. | 315/219 |
| 2009/0236999 | A1 | 9/2009 | Yufuku et al. | |
| 2009/0323033 | A1 | 12/2009 | Konishi et al. | |
| 2010/0013393 | A1 | 1/2010 | Onishi et al. | |

FOREIGN PATENT DOCUMENTS

| | | |
|---|---|---|
| JP | 63-86396 | 4/1988 |
| JP | 10-284275 | 10/1998 |
| JP | 2002-141184 | 5/2002 |
| JP | 2003-249391 | 9/2003 |
| JP | 3858317 | 12/2006 |

* cited by examiner

*Primary Examiner* — Douglas W Owens
*Assistant Examiner* — Amy Yang
(74) *Attorney, Agent, or Firm* — Greenblum & Bernstein, P.L.C.

(57) ABSTRACT

A series circuit comprising a diode and a resistance is connected in parallel to a filament, and a series circuit comprising a diode and a resistance is connected in parallel to a filament. The filaments are preheated by a preheating current supplied from secondary windings of a preheating transformer, via preheating capacitors. Detection circuits detect DC voltage components of the preheating capacitors. Comparators compare the DC voltage components of the preheating capacitors with a reference voltage. The comparators cause a control circuit to protect the inverter circuit if an abnormality of the filaments is detected.

8 Claims, 8 Drawing Sheets

DISCHARGE LAMP OPERATING DEVICE, ILLUMINATION DEVICE AND LIQUID CRYSTAL DISPLAY DEVICE

TECHNICAL FIELD

The present invention relates to a discharge lamp operating device which operates a discharge lamp having a filament at high frequency, and to an illumination device and liquid crystal display device using same.

BACKGROUND ART

In recent years, light sources which illuminate a display surface from the rear side (backlights) have been commonly used in liquid crystal display devices for personal computers, OA devices, liquid crystal televisions, or the like, and illumination devices such as signboard lamps. Of these, a direct backlight is known which comprises a plurality of discharge lamps arranged on a reflector plate and a diffuser plate which is disposed over the discharge lamps.

In the field of liquid crystal display devices, there are demands for large screen size, high luminosity and uniformity. Consequently, there is a tendency for the number of discharge lamps used per device to increase, and for the tube voltage of the discharge lamps used to operate at higher voltage. For example, in a 32-inch backlight using CCFL (Cold Cathode Fluorescent Lamps), the tube voltage is around 1 kV rms. Therefore, it is not possible to ignore the effects of the parasitic capacitance between the high impedance load and the housing, a bias occurs in the luminosity distribution of the discharge lamps due to the effects of current leaking to the housing, and hence there is a problem in that the luminosity becomes non-uniform.

Therefore, a possibility might be to use hot cathode fluorescent lamps (HCFL) which have a higher output and lower tube voltage than CCFL. If HCFL are used, then it is possible to reduce the number of discharge lamps and to reduce the operating circuits, compared to CCFL. Furthermore, since the tube voltage is low and the leakage current flowing in the parasitic capacitance between the discharge lamps and the housing is low, then there is little bias in the luminosity of the discharge lamps. Moreover, since noise is low, then there is also little effect on peripheral circuits.

However, in a discharge lamp operating device which operates HCFL at high frequency by means of an inverter circuit, if the filament of a discharge lamp becomes disconnected, for instance, when in a loadless state (a state where the discharge lamp is removed) or at the end of the lifespan of the lamp, or the like, then if the oscillation of the inverter circuit is continued, a high voltage will occur between the output section and the socket section, and there is a risk of danger, such as electric shock. Therefore, in the event of an abnormality such as that described above, it is normal to halt the oscillation of the inverter circuit compulsorily.

Patent Document 1 discloses a composition in which, in order to preheat a pair of filaments of a discharge lamp, a resonance capacitor (capacitor C1) is connected between the non-power source side terminal of one filament and the non-power source side terminal of the other filament, the voltage across the stem of the discharge lamp is detected, and if this voltage has exceeded a prescribed value which indicates disconnection of the filament, then the inverter circuit is halted or the output thereof is reduced.

In a discharge operating device in which a resonant capacitor also serves as a preheating capacitor, as in Patent Document 1, the current in the filaments is determined by the resonance characteristics. However, a filament has characteristics whereby the resistance value becomes greater when the filament heats up. Consequently, if a fixed current is passed through a filament, the voltage becomes greater in accordance with the resistance value, and even if a filament is in a normal condition, the voltage across the stem varies greatly. Consequently, the detection threshold value of a comparator for detecting the voltage across the stem must be set higher than the range of variation of the voltage across the stem in a normal state. Accordingly, in the discharge lamp operating device in Patent Document 1, there is a problem in that the accuracy of detecting disconnection of the filaments is low.

If discharge lamps are used as a backlight for a liquid crystal television, then reduction in the thickness of the backlight is desired, and there is a tendency for the discharge lamp tubes to be become finer. Moreover, in a liquid crystal television, long lifespan of the backlight is desirable, and the preheating conditions of the filaments are subjected to strict restrictions. Therefore, it is desirable to use a discharge lamp operating device which is able to designate the preheating current of the filaments, independently of the resonance characteristics of the discharge lamp operating device.

Patent Document 2 discloses a discharge lamp operating device based on a winding preheating system which passes a preheating current through a filament by using a preheating transformer, in which a direct current is passed through the filaments of the discharge lamps, and disconnection of a filament is detected by the presence or absence of this direct current. In this discharge lamp operating device, it is possible to designate the preheating current independently of the resonance characteristics, but since the preheating current of the filaments varies with the resistance value of the filaments, then there is little voltage change across the stem.

However, in the discharge lamp operating device shown in Patent Document 2, since a direct current is passed through the filament, then a resistance is connected between the DC power source unit and the filament. In this case, if stresses, such as the starting voltage of the discharge lamps, and the like, are taken into account, then it is necessary to arrange a plurality of resistances in series, and there is a problem in that the number of components becomes greater.

Furthermore, if the direct current power source section and the discharge lamp load need to be isolated, then a separate power source for detecting disconnection of the filaments becomes necessary and there is a problem in that the number of components becomes greater.

DISCLOSURE OF THE INVENTION

The object of the present invention is to provide a discharge lamp operating device, an illumination device and a liquid crystal display device, whereby it is possible to detect disconnection of filaments in a stable fashion, without increasing the number of components.

[Patent Document 1] U.S. Pat. No. 3,858,317

[Patent Document 2] Japanese Patent Application Laid-open Publication No. 10-284275

The discharge lamp operating device according to the present invention is a discharge lamp operating device which operates a discharge lamp having a filament, characterized in comprising: an inverter circuit which converts an output from a DC power source unit to a high-frequency output and supplies the output to the discharge lamp; a filament preheating circuit comprising a preheating winding for supplying a preheating current to the filament and a preheating capacitor connected between the preheating winding and the filament; a series circuit comprising a serially connected rectifying element and resistance, the circuit being connected in parallel to the filament; a detection circuit which detects a DC voltage component of the preheating capacitor; a comparator which compares the output of the detection circuit with a reference voltage; and a control circuit which receives the output of the comparator and limits the output of the inverter circuit or halts the operation of the inverter circuit.

Furthermore, the illumination device according to the present invention is characterized in comprising the discharge lamp operating device described above.

Moreover, the liquid crystal display device according to the present invention is characterized in comprising the discharge lamp operating device described above.

BEST MODE FOR CARRYING OUT THE INVENTION

First Embodiment

Figure 1:
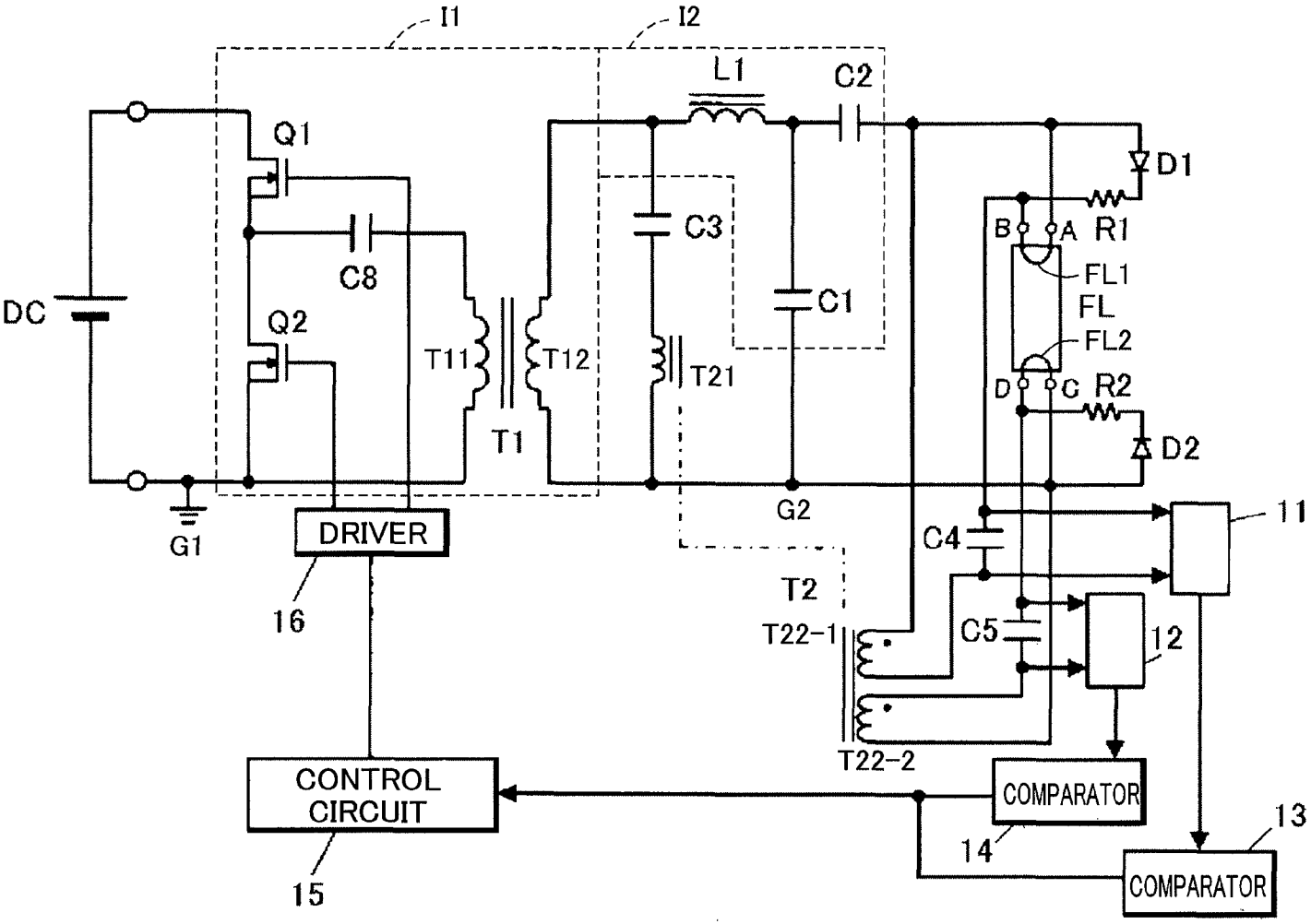
FIG. 1 is a circuit diagram of a discharge lamp operating device according to a first embodiment of the present invention.

FIG. 1 is a circuit diagram of a discharge lamp operating device according to a first embodiment of the present invention. A direct current power source unit DC is constituted by a power source circuit which outputs a prescribed DC voltage, and comprises, for example, a rectifying circuit which performs full-wave rectification of a commercial AC voltage, and a boost chopper circuit which boosts and smoothes the full-wave rectified commercial AC voltage.

The negative electrode of the DC power source unit DC is connected to a primary side reference potential G1 (ground). A half bridge circuit constituted by serially connected switching elements Q1 and Q2 is connected between the positive electrode and the negative electrode of the DC power source unit DC. The switching elements Q1 and Q2 are constituted by power MOSFET, for example, and switch alternately on and off at high frequency by receiving the output of a control circuit 15 via a driver 16. A primary winding T11 of an isolation transformer T1 is connected via a "DC-cut" capacitor C8 to either end of the switching element Q2.

The switching elements Q1, Q2, the DC-cut capacitor C8 and the isolation transformer T1 constitute an inverter circuit I1. The inverter circuit I1 converts the output from the DC power source unit DC into a high-frequency output, which it supplies to the discharge lamp FL.

A series circuit comprising a capacitor C3 and the primary winding T21 of a preheating transformer T2 is connected in parallel to the secondary winding T21 of an isolation transformer T1. The preheating transformer T2 comprises a primary winding T21 which receives the output of the inverter circuit I1 and a pair of secondary windings T22-1 and T22-2 which are coupled magnetically to the primary winding T21. The secondary winding T22-1 is connected to the filament FL1 via a preheating capacitor C4. The secondary winding T22-2 is connected to the filament FL2 via a preheating capacitor C5.

The discharge lamp FL is a hot cathode type fluorescent lamp having filaments FL1 and FL2. A filament preheating circuit is constituted by the capacitor C3, the preheating capacitors C4 and C5, and the preheating transformer T2.

A resonance circuit I2 is connected to the secondary winding T12 of the isolation transformer T1. The resonance circuit I2 comprises an inductor L1 and the capacitors C1 and C2. The discharge lamp FL is connected to the resonance circuit I2, and supplies a high-frequency output from the inverter circuit I1, to the discharge lamp FL. The capacitor C2 of the resonance circuit I2 is connected between the inductor L1 and the terminal A of the filament FL1. The capacitor C1 of the resonance circuit I2 is connected between the terminal C of the filament FL2 and the inductor L1.

The terminal B is connected to the secondary winding T22-1 via the preheating capacitor C4. Furthermore, the terminal D is connected to the secondary winding T22-2 via the preheating capacitor C5.

A series circuit comprising a diode D1 (one example of a rectifying element) and a resistance R1 is connected in parallel between terminal A and terminal B of the filament FL1. The anode of the diode D1 is connected to the capacitor C2 and the cathode thereof is connected to the resistance R1.

Furthermore, a series circuit comprising a diode D2 and a resistance R2 is connected in parallel between terminal C and terminal D of the filament FL2. The anode of the diode D2 is connected to an isolation transformer T1 and the cathode thereof is connected to the resistance R2.

Here, the potential of the terminal C is taken as the secondary side reference potential G2, and the terms high-voltage side and low-voltage side are used with reference to the secondary side reference potential G2. Consequently, the filament FL1 is a high-voltage-side filament and the filament FL2 is a low-voltage-side filament. The secondary side reference potential G2 is insulated from the primary side reference potential G1 by the isolation transformer T1.

A detection circuit 11 is connected in parallel to the preheating capacitor C4 and detects the DC voltage component of the preheating capacitor C4. By this means, disconnection of the filament FL1 is detected. A detection circuit 12 is connected in parallel to the preheating capacitor C5 and detects the DC voltage component of the preheating capacitor C5. By this means, disconnection of the filament FL2 is detected.

A comparator 13 compares the output of the detection circuit 11 with a reference voltage (not illustrated). Furthermore, a comparator 14 compares the voltage of the detection circuit 12 with a reference voltage (not illustrated). Here, for the reference voltage, it is possible to use a predetermined desirable voltage for detecting disconnection.

The control circuit 15 generates a drive signal for driving the switching elements Q1 and Q2, for example, and changes the oscillation frequency of the drive signal, or halts the drive signal, in accordance with the output from the comparators 13 and 14. Here, a PWM signal, for instance, is used as the drive signal.

The polarity of the DC voltage with which the preheating capacitors C4, C5 are charged is determined by the orientation of the diodes D1, D2. The preheating capacitors C4, C5 are charged to the same polarity even in cases where a filament FL1, FL2 is detached from one of the terminals A to D. The polarity of the DC voltage component charged to the preheating capacitors C4, C5 should be taken into account in composing the detection circuits 11, 12, and hence there are no particular restrictions on the orientation of the diodes D1, D2.

However, in order to suppress bias magnetism of the preheating transformer T2, as shown in FIG. 1, it is desirable that the orientation of the diodes D1 and D2 should be of mutually opposite polarity, in such a manner that the diode D1 operates in the forward direction if the output of the preheating transformer T2 is of one polarity, and the diode D2 operates in the forward direction if the output is of the other polarity. In other words, in the present discharge lamp operating device, the output of the preheating transformer T2 also serves as a DC power source for detecting disconnection of the filaments FL1, FL2, and if the equivalent resistance of the filaments FL1 and FL2 becomes large, then the preheating capacitors C4, C5 are charged from the preheating transformer T2 via the diodes D1, D2 and the resistances R1, R2.

Figure 2:
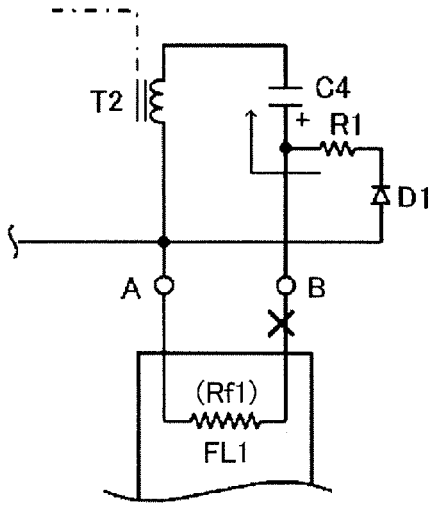
FIG. 2 is an explanatory diagram of the operation of the discharge lamp operating device shown in FIG. 1.

FIG. 2 is an explanatory diagram of the operation of the discharge lamp operating device shown in FIG. 1. Here, the operation in the event of disconnection of the high-voltage-side filament FL1 is described, but the basic operation is the same in the case of the disconnection of the low-voltage-side filament FL2. The arrows in FIG. 2 indicate the flow of the DC current.

The equivalent resistance of the filament FL1 is taken to be Rf1. The relationship between the equivalent resistance Rf1 and the resistance R1 during normal circumstances is Rf1<<R1. Even if the preheating capacitor C4 is charged by the DC current flowing in the preheating capacitor C4 from the preheating transformer T2 and via the diode D1 and resistance R1, the charging load on the preheating capacitor C4 is discharged via the filament if the polarity of the output of the preheating transformer T2 is reversed. Consequently, virtually no DC voltage component is left in the preheating capacitor C4. Therefore, the DC voltage component of the preheating capacitor C4 is virtually zero during normal operation.

It is now supposed that the filament FL1 has become disconnected and the equivalent resistance Rf1 of the filament FL1 has increased. Below, disconnection of the filament FL1 includes: breakage of the filament FL1, detachment of the filament FL1 from the terminal, contact defects at the terminals A to D, and so on. In this case, the preheating capacitor C4 is charged by the DC current flowing in the preheating capacitor C4 from the preheating transformer T2 via the diode D1 and the resistance R1, and if the polarity of the preheating transformer T2 is reversed, the charging load on the preheating capacitor C4 either is not discharged via the filament FL1, or becomes less liable to be discharged via same in comparison with normal circumstances. As a result of this, a DC voltage component is generated in the preheating capacitor C4. Disconnection of the filament FL1 can be detected by detecting this DC voltage component.

Figure 3:
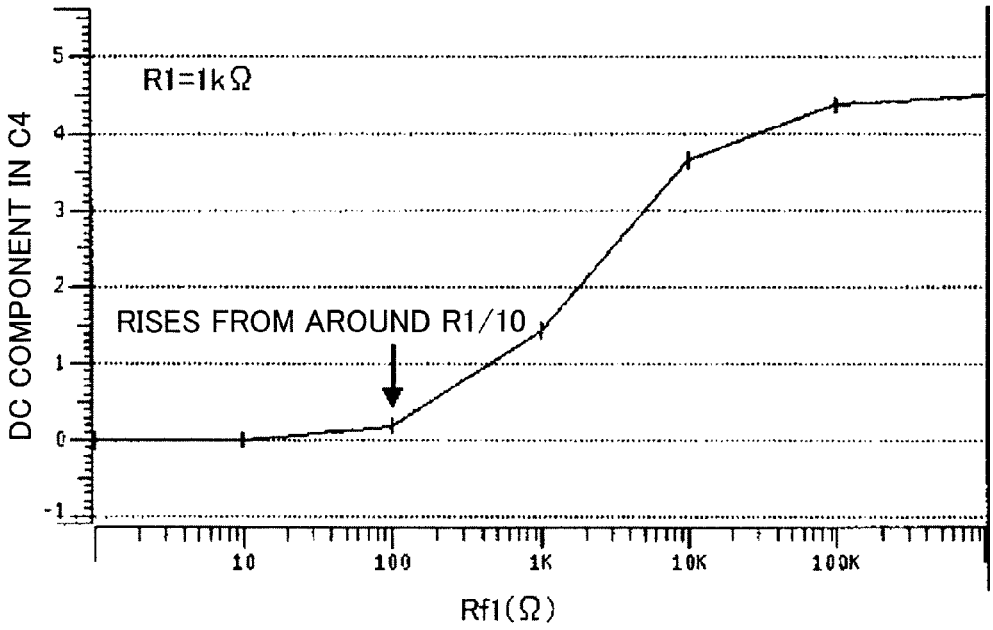
FIG. 3 shows the change in the DC voltage component of the preheating capacitor with respect to change in the resistance of the filament.

FIG. 3 shows the change in the DC voltage component of the preheating capacitor with respect to change in the resistance of the filament. The horizontal axis represents the equivalent resistance Rf1 of the filament FL1 and the vertical axis represents the DC voltage component of the preheating capacitor C4. It can be seen that the DC voltage component increases from about an equivalent resistance Rf1 of R1/10. In FIG. 3, R1=1 kΩ. If the resistance R1 is an excessively small value, then a DC voltage component occurs in the preheating capacitor C4 even at the resistance of the filament FL1 during normal operation. Therefore, if the hot resistance of the filament FL1 is taken to be Rh, then it is desirable that at least R1>Rh, and in practical terms, that R1>10×Rh.

Figure 4:
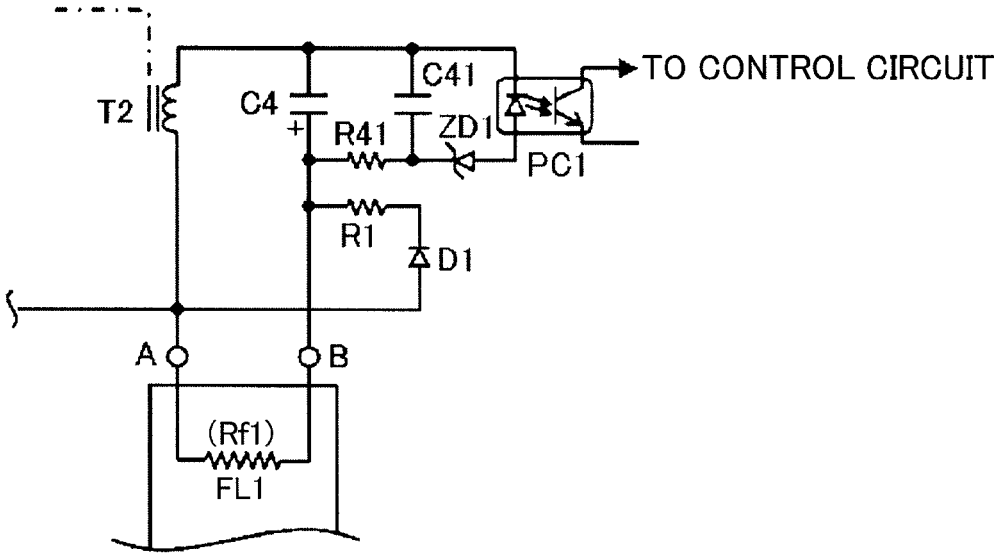
FIG. 4 shows a circuit diagram of the detection circuit and the comparator which are used in the discharge lamp operating device shown in FIG. 1.

FIG. 4 shows a circuit diagram of the detection circuit 11 and the comparator 13 which are used in the discharge lamp operating device shown in FIG. 1. The detection circuit 11 includes a resistance R41 and a capacitor C41, thereby smoothing the voltage of the preheating capacitor C4. The comparator 13 comprises a photocoupler PC1 and a Zener diode ZD1. The anode of the Zener diode ZD1 is connected to the photocoupler PC1, and the cathode thereof is connected to the capacitor C41. The primary side of the photocoupler PC1 is connected to the Zener diode ZD1, and the secondary side thereof is connected to the control circuit 15.

If the DC voltage of the capacitor C41 exceeds the voltage of the Zener diode ZD1, then the Zener diode ZD1 switches on and the photocoupler PC1 switches on. In response to this, the control circuit 15 protects the inverter circuit I1.

In this way, by means of a discharge lamp operating device according to the present embodiment, since a series circuit comprising diodes D1, D2 and resistances R1, R2 is connected in parallel to the filaments FL1, FL2, and since the preheating capacitors C4, C5 detect the DC voltage component, then it is possible to detect disconnection of the filaments FL1, FL2 by means of a simple composition, without having to provide a separate DC power source unit on the secondary side.

Furthermore, since there is no need for a resistance for passing a DC current from the DC power source unit to the filaments, as indicated in Patent Document 2, then it is possible to reduce the number of components, and it is also possible to detect disconnection of the filaments in a stable fashion.

In FIG. 1, a preheating transformer T2 is connected via a DC-cut capacitor C3 to the secondary winding T12 of the isolation transformer T1, but the secondary windings T22-1 and T22-2 of the preheating transformer T2 may also be provided on the secondary side of the isolation transformer T1. Alternatively, the preheating transformer T2 may also be connected via a DC-cut capacitor C3 between the source and drain of the switching element Q2. Moreover, in FIG. 1, the switching elements Q1 and Q2 serve jointly as switching elements for the filament preheating circuit and switching elements for the inverter circuit I1, but the present invention is not limited to this. More specifically, it is also possible to provide a separate switching element for the filament preheating circuit and for the control circuit 15 to control this switching element independently of the inverter circuit I1. Furthermore, in FIG. 1, it is also possible to omit the resonance circuit I2. These modification examples can also be applied to the respective embodiments described below.

Second Embodiment

Figure 5:
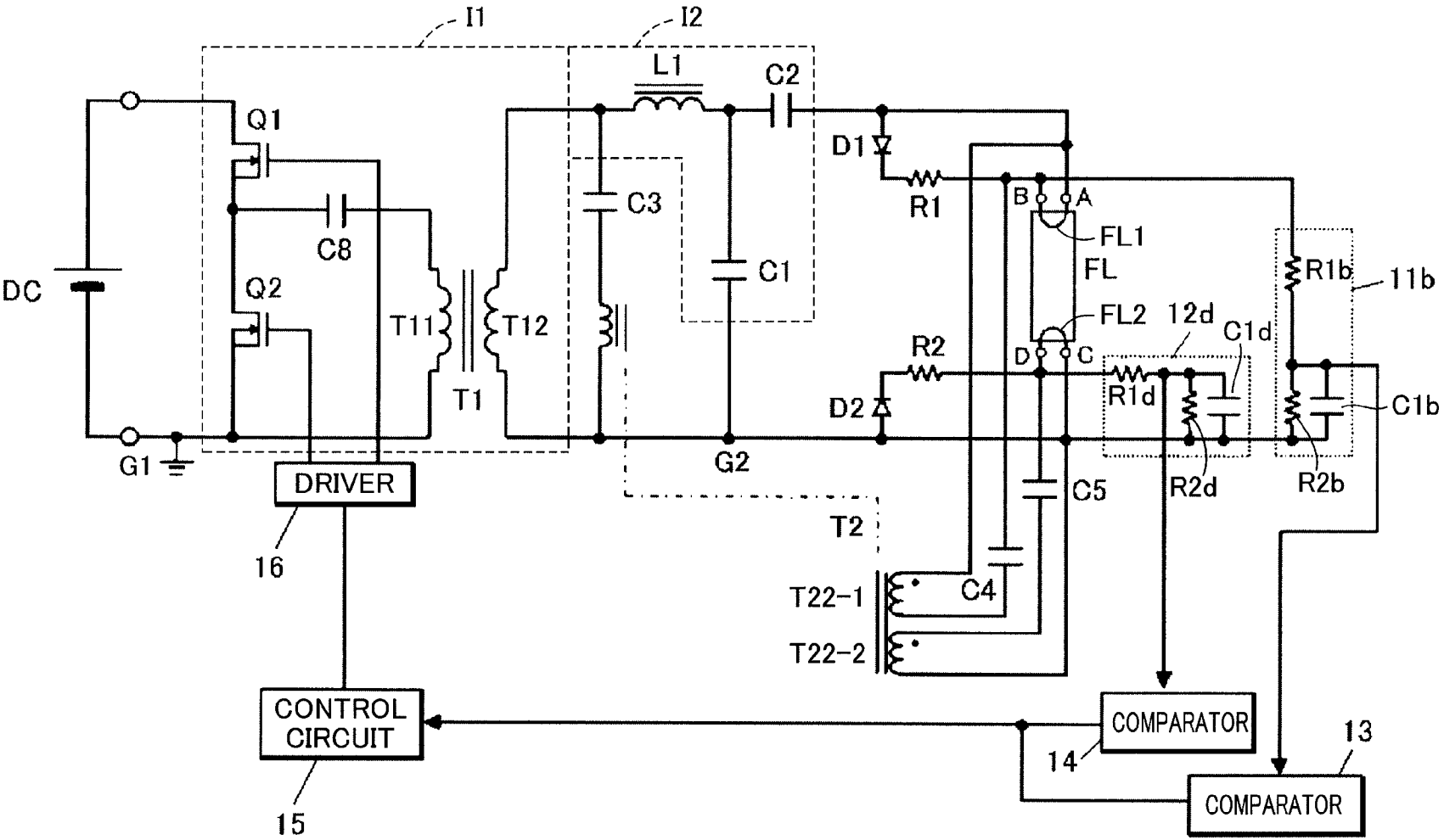
FIG. 5 shows a circuit diagram of a discharge lamp operating device according to a second embodiment of the present invention.

FIG. 5 shows a circuit diagram of a discharge lamp operating device according to a second embodiment of the present invention. A characteristic feature of the present embodiment is that, in order to detect the DC voltage components of the preheating capacitors C4, C5, the DC voltage component at the terminals B and D is detected with reference to the secondary-side reference potential G2.

A detection circuit 11*b* for detecting the DC voltage component with respect to the secondary-side reference potential G2 is connected to the terminal B. Furthermore, a detection circuit 12*d* for detecting the DC voltage component with respect to the secondary-side reference potential G2 is connected to the terminal D.

The detection circuit 11*b* comprises resistances R1*b*, R2*b* and a capacitor C1*b*. The resistance R1*b* is connected in series to a parallel circuit comprising the resistance R2*b* and the capacitor C1*b*. The time constant of the resistances Rib and R2*b* and the capacitor C1*b* is set to a value whereby the input high-frequency voltage can be smoothed and the DC voltage component thereof can be detected and output.

The detection circuit 12*d* comprises resistances R1*d*, R2*d*, and a capacitor C1*d*. The resistance R1*d* is connected in series to a parallel circuit comprising the resistance R2*d* and the capacitor C1*d*. The time constant of the resistances R1*d*, R2*d* and the capacitor C1*d* is set to a value whereby the input high-frequency voltage can be smoothed and the DC voltage component thereof can be detected and output.

The input impedance of the detection circuits 11*b* and 12*d* is set to a higher value than the equivalent resistance of the filaments FL1 and FL2.

<Description of Operation in Event of Disconnection of Filament FL2>

If the filament FL2 is not disconnected, then the equivalent resistance of the filament FL2 is sufficiently small. Furthermore, the diode D2 and the resistance R2 are connected to the filament FL2. Therefore, the major part of the DC voltage component generated by the series circuit comprising the diode D2 and the resistance R2 is consumed by the filament FL2, and the DC voltage component at the terminal D of the filament FL2 is virtually zero. Consequently, the output of the detection circuit 12*d* is also virtually zero.

If the filament FL2 is disconnected and the equivalent resistance of the filament FL2 has increased, then since the diode D2 and the resistance R2 are connected, the filament FL2 is no longer able to consume all of the DC voltage component generated by the DC circuit comprising the diode D2 and the resistance R2. Therefore, the DC voltage component is charged to the preheating capacitor C5, and a DC voltage component is generated at terminal D. The voltage at terminal D is smoothed by the detection circuit 12*d* and the DC voltage component thereof is input to the comparator 14.

The comparator 14 judges that the filament FL2 has become disconnected and outputs an abnormality judgment signal to the control circuit 15 if the output of the detection circuit 12*d* exceeds a reference voltage. Upon receiving the abnormality judgment signal, the control circuit 15 protects the inverter circuit I1 by either changing the drive signal to a prescribed oscillating frequency, or by halting oscillation, in such a manner that the discharge lamp operating device does not assume a dangerous mode.

<Description of Operation in Event of Disconnection of Filament FL1>

If the filament FL1 is not disconnected, then the equivalent resistance of the filament FL1 is sufficiently small, and since the diode D1 and the resistance R1 are connected, then the major part of the DC voltage component generated by the series circuit comprising the diode D1 and the resistance R1 is consumed by the filament FL1. Therefore, the DC voltage component of the filament FL1 at terminal B is virtually zero, and the output of the detection circuit 11*b* is virtually zero.

If the filament FL1 is disconnected and the equivalent resistance of the filament FL1 has increased, then since the diode D1 and the resistance R1 are connected, the filament FL1 is no longer able to consume all of the DC voltage component generated by the DC circuit comprising the diode D1 and the resistance R1. Therefore, the DC voltage component is charged to the preheating capacitor C4, and a DC voltage component is generated at terminal B. The detection circuit 11*b* smoothes the voltage at the terminal B and outputs the DC voltage component thereof to the comparator 13. The comparator 13 judges that the filament has become disconnected and outputs an abnormality judgment signal to the control circuit 15 if the output of the detection circuit 11*b* exceeds a reference voltage. Upon receiving the abnormality judgment signal, the control circuit 15 protects the inverter circuit I1 by either changing the oscillating frequency of the drive signal or by halting oscillation of the drive signal, in such a manner that the discharge lamp operating device does not assume a dangerous mode.

In this way, according to the discharge lamp operating device of the second embodiment, even if the power source and the load are insulated from each other by the preheating transformer T2, it is possible to protect the inverter circuit I1 and to improve safety by detecting disconnection of the filaments FL1 and FL2.

Furthermore, if the emitter of either one of the filaments FL1 and FL2 wears out at the end of the lifespan of the discharge lamp FL and a rectifying effect appears in the discharge lamp FL, then a substantially similar DC voltage component occurs at the terminals A and B. This DC voltage component is detected by the detection circuit 11*b*. In this case, the comparator 13 is constituted by a window comparator which is provided with two reference voltages. The comparator 13 judges that the discharge lamp FL has not reached the end of its life provided that the DC voltage component at terminal B is within the range of the two reference voltages, and judges that the discharge lamp FL has reached the end of its life if the DC voltage component at terminal B is outside the range of the two reference voltages, in which case the comparator 13 outputs an abnormality judgment signal to the control circuit 15 so as to protect the inverter circuit I1. By this means, it is also possible to provide protection at the end of the lifespan of the discharge lamp FL.

The secondary windings T22-1 and T22-2 of the preheating transformer T2 output a rectangular AC voltage waveform, and the DC voltage component is basically zero. Therefore, an AC voltage is applied to the filaments FL1 and FL2. In a state where the filament lamp FL has not reached the end of its lifespan, the DC voltage components at the terminals A and B are both substantially zero, in other words, the DC voltage components at the terminals A and B are equal to each other.

On the other hand, if the discharge lamp FL reaches the end of its life and a rectifying effect appears in the discharge lamp FL, then the terminal voltage of the discharge lamp FL (the voltage between the filament FL1 and the filament FL2) assumes positive/negative symmetry. In other words, a DC voltage component is generated at both ends of the discharge lamp FL. The polarity of this DC voltage component is determined by which of the filaments FL1 or FL2 has an emitter that is worn out. Here, since the terminal C is earthed, then a DC voltage component is generated at the terminals A and B. Consequently, by composing a detection circuit 11*b* by means of a window comparator, if a positive or negative DC voltage component has been generated at terminal B due to the discharge lamp FL having reached the end of its lifespan, then this can be detected, and it is possible reliably to detect the lifespan of the discharge lamp FL.

More specifically, one reference voltage of the two reference voltages of the window comparator should be set to the value of the positive DC voltage component which is expected to occur at the terminal B if the discharge lamp FL has reached the end of its lifespan, and the other reference voltage should be set to the negative DC voltage component which is expected to occur at the terminal B if the discharge lamp FL has reached the end of its lifespan.

The polarity of the DC voltage component appearing at terminal B when the filament FL1 has become disconnected is determined by the polarity of the diode D1. Consequently, one of the two reference voltages of the window comparator serves both for judging the disconnection of the filament FL1 and for judging the end of the lifespan of the discharge lamp FL.

Consequently, in FIG. 5, it is not possible to distinguish between the detection of the end of the lifespan of the discharge lamp FL and the detection of disconnection of the filament FL1. On the other hand, in the first embodiment described above, or the following third embodiment, it is possible reliably to detect disconnection of the filament FL1 by detecting the voltage change of the preheating capacitor C4, regardless of whether or not the discharge lamp FL has reached the end of its lifespan.

In FIG. 5, the detection circuit 11*b* is connected to the terminal B, but it may also be connected to the terminal A.

Third Embodiment

Figure 6:
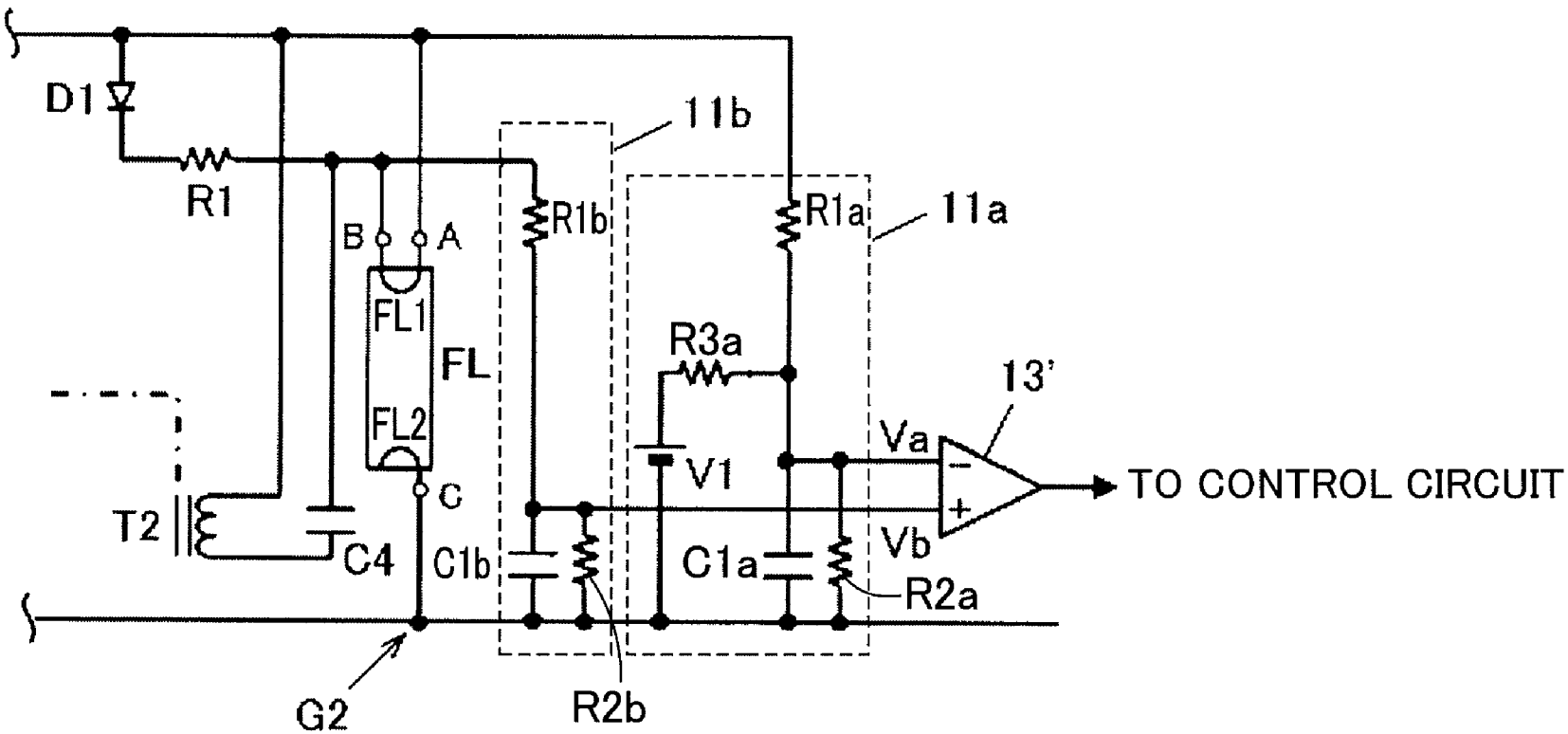
FIG. 6 shows a circuit diagram of a detection circuit in a discharge lamp operating device according to a third embodiment of the present invention.

The discharge lamp operating device according to the third embodiment is characterized in employing a composition which, of detection of disconnection of the filament and detection of the end of the lifespan of the discharge lamp FL, is able to detect only disconnection of the filament. FIG. 6 shows a circuit diagram of the detection circuits 11*a*, 11*b* in a discharge lamp operating device according to a third embodiment of the present invention. Here, the detection circuit 11*a* relating to the filament FL1 is depicted, but it is also possible to employ a detection circuit having a similar composition to the detection circuit 11*a*, in relation to the filament FL2.

The detection circuit 11*a* comprises resistances R1*a*, R2*a*, R3*a*, a capacitor C1*a* and a DC power source unit V1. The resistance R1*a* is connected to the secondary side reference potential G2 via the capacitor C1*a*. The capacitor C1*a* is connected to the negative terminal of a comparator 13'. The resistance R2*a* is connected in parallel to the capacitor C1*a*. One end of the resistance R3*a* is connected to the negative terminal of the comparator 13', and the other end thereof is connected to the secondary side reference potential G2 via the DC power source unit V1.

The detection circuit 11*b* comprises resistances R1*b*, R2*b* and a capacitor C1*b*. The resistance R2*b* is connected to the positive terminal of a comparator 13'. The resistance Rib is connected to the secondary side reference potential G2 via the capacitor C1*b*. The resistance R2*b* is connected in parallel to the capacitor C1*b*.

In the circuit in FIG. 6, the DC voltage components at the terminals A and B of the filament FL1 are respectively detected by the detection circuits 11*a* and 11*b*, and these are compared by the comparator 13'. Furthermore, in order to enable easy judgment of the presence or absence of disconnection of the filament FL1, the detected voltage Va at terminal A which is detected by the detection circuit 11*a* is superimposed with a DC voltage from the DC power source unit V1. The detected voltage Va is taken as the reference voltage of the comparator 13'. Furthermore, the detected voltage of the terminal B detected by the detection circuit 11*b* is taken as Vb.

If there is no disconnection of the filament FL1, then the DC voltage component of the preheating capacitor C4 is virtually zero. In this case, since there is virtually no differential between the DC voltage components at the terminal A and the terminal B, then due to the bias produced by the DC power source unit V1, Va>Vb.

If the filament FL1 is disconnected, a DC voltage component occurs in the preheating capacitor C4, and with the polarity of the diode D1 shown in FIG. 6, the DC voltage component at terminal B rises above the DC voltage component at terminal A. In this case, the circuit time constants of the detection circuits 11*a* and 11*b* are set in such a manner that Va<Vb. Consequently, if an abnormality has occurred in the discharge lamp FL, the output of the comparator 13' is reversed and therefore the control circuit 15 can be made to protect the inverter circuit I1.

On the other hand, if the discharge lamp FL has reached the end of its lifespan and a rectifying effect has appeared in the discharge lamp FL, then if the filament FL1 is not disconnected, the DC voltage component between the terminals A and B is virtually zero, and therefore Va>Vb. Consequently, the end of the lifespan of the discharge lamp FL is not detected.

According to the discharge lamp operating device according to the present embodiment, the reference voltage for detecting disconnection of the filament is decided by the DC power source unit V1, and therefore it is possible to detect disconnection of the filament only.

In FIG. 6, if the end of the lifespan of the discharge lamp FL is to be detected, then a separate window comparator should be provided to which the output of at least one of the detection circuits 11*a* and 11*b* is input. The window comparator judges that the discharge lamp FL has reached the end of its lifespan and outputs an abnormality judgment signal to the control circuit 15, if the output of the detection circuit 11*a* or the detection circuit 11*b* is outside the range of the two reference voltages. The control circuit 15 should then transfer the inverter circuit I1 to protected operation. By this means, it is possible to protect the discharge lamp FL at the end of the lifespan.

Fourth Embodiment

Figure 7:
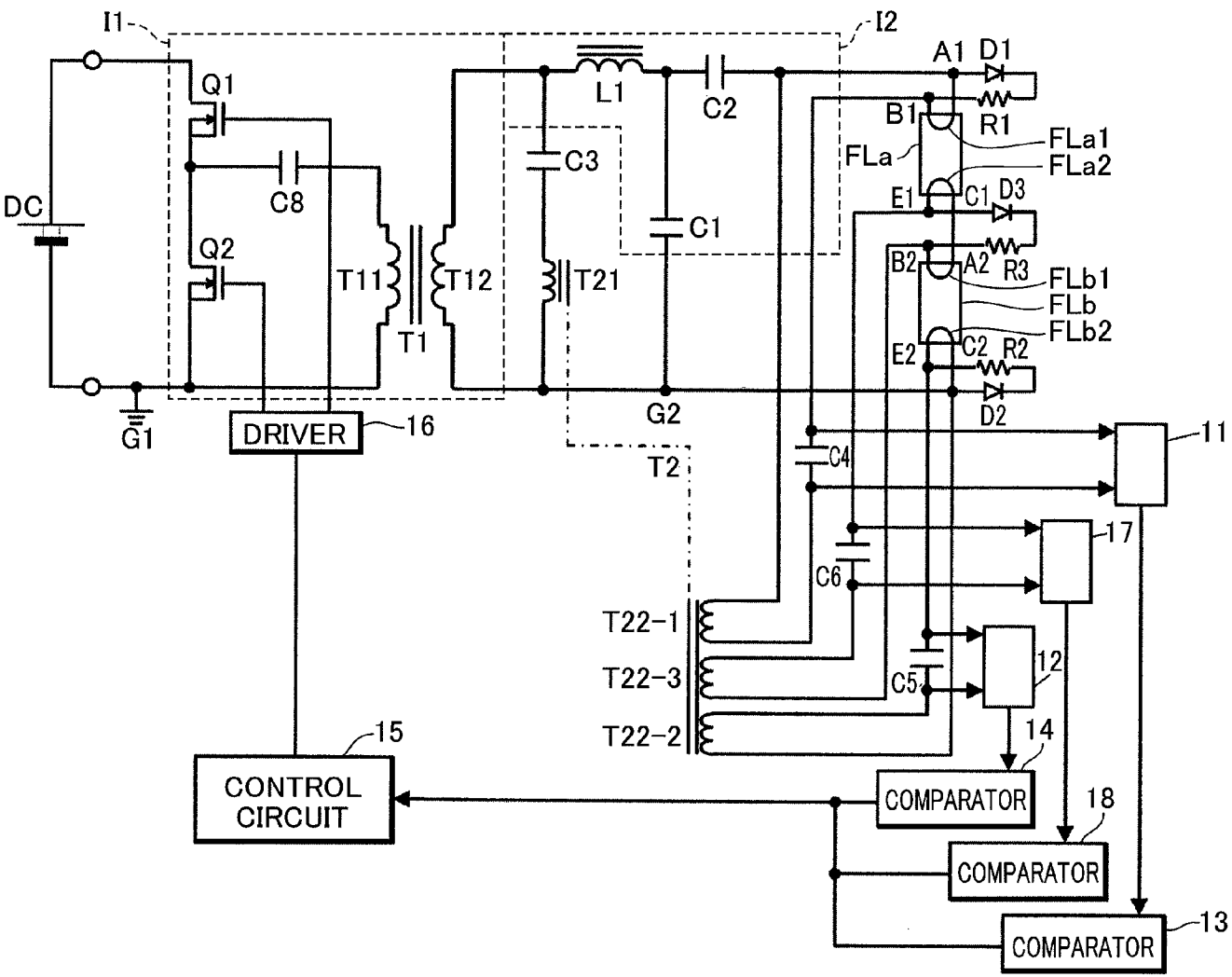
FIG. 7 shows a circuit diagram of a discharge lamp operating device according to a fourth embodiment of the present invention.

FIG. 7 shows a circuit diagram of a discharge lamp operating device according to a fourth embodiment of the present invention. The discharge lamp operating device according to the fourth embodiment is characterized in that a plurality of discharge lamps are connected in series. Parts of the present embodiment which are the same as the first to third embodiments are not described further here. In the case shown in FIG. 7, two discharge lamps FLa and FLb are connected in series. The discharge lamp FLa comprises filaments FLa1 and FLa2. A filament FLa1 is connected between the terminal A1 and the terminal B1. A filament FLa2 is connected between the terminal C1 and the terminal E1.

The discharge lamp FLb comprises filaments FLb1 and FLb2. The filament FLb1 is connected between the terminal A2 and the terminal B2. The filament FLb2 is connected between the terminal C2 and the terminal E2.

The filament FLa2 and the filament FLb1 are connected via the terminal C1 and the terminal A2. The terminal E1 is connected to the terminal B2 via a series circuit comprising a diode D3 and a resistance R3.

The preheating transformer T2 also comprises one secondary winding T22-3, in addition to the pair of secondary windings T22-1 and T22-2. One end of the secondary winding T22-3 is connected to the terminal B2 and the other end thereof is connected to the terminal E1 via a capacitor C6.

A detection circuit 17 is connected in parallel to the capacitor C6. A detection circuit 17 outputs the DC voltage component of the capacitor C6 to a comparator 18 in order to detect disconnection of the filaments FLa2 and FLb1.

The comparator 18 judges that disconnection of a filament FLa2, FLb1 has occurred and outputs an abnormality judgment signal to the control circuit 15, if the output from the detection circuit 17 has exceeded a prescribed reference voltage (not illustrated). The control circuit 15 protects the inverter circuit I1 if an abnormality judgment signal is input thereto.

If the filaments FLa2, FLb1 have become disconnected, then the polarity of the DC voltage component which is charged to the capacitor C6 is determined by the orientation of the diode D3. Furthermore, whichever one of the filaments FLa2 and FLb1 has become disconnected, the capacitor C6 is charged to the same polarity. Consequently, the polarity of the DC voltage component charged to the capacitor C6 should be taken into account in composing the detection circuit 17, and hence there are no particular restrictions on the orientation of the diode D3.

Figure 8:
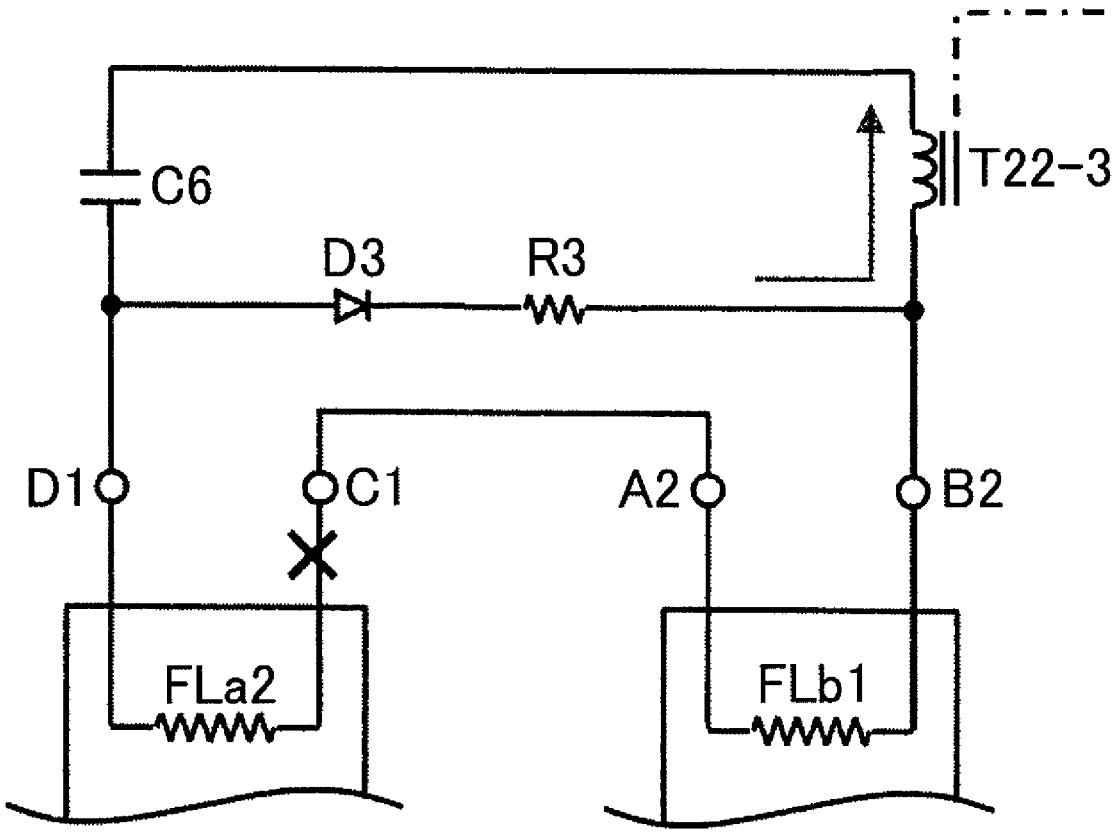
FIG. 8 is an explanatory diagram of the operation of the discharge lamp operating device shown in FIG. 7.

FIG. 8 is an explanatory diagram of the operation of the discharge lamp operating device shown in FIG. 7. The arrow in FIG. 8 indicates the direction of the DC current. If neither of the filaments FLa2 and FLb1 is disconnected, then even if the capacitor C6 is charged with a DC current, the charging load of the capacitor C6 is discharged via the filaments FLa2 and FLb1 if the polarity of the secondary winding T22-3 is inverted. Therefore, the capacitor C6 is hardly charged at all by the DC voltage component. Consequently, the DC voltage component of the preheating capacitor C6 is virtually zero during normal operation.

Now, it is supposed that the filament FLa2 has become disconnected. In this case, the capacitor C6 is charged by the DC current, and if the polarity of the secondary winding T22-3 is reversed, the charging load of the capacitor C6 is either discharged via the filament FLa2 or becomes less liable to be discharged than during normal operation.

As a result of this, a DC voltage component is generated in the capacitor C6. Disconnection of the filament FLa2 can be detected by detecting this DC voltage component.

In this way, according to the discharge lamp operating device of the fourth embodiment, it is possible to detect disconnection of the two filaments FLa2 and FLb1 by means of one series circuit comprising a diode D3 and a resistance R3, one capacitor C6, one detection circuit 17 and one comparator 18, and therefore it is possible to detect disconnection of the two filaments FLa2 and FLb1 without increasing the number of components.

(Liquid Crystal Display Device)

Figure 9:
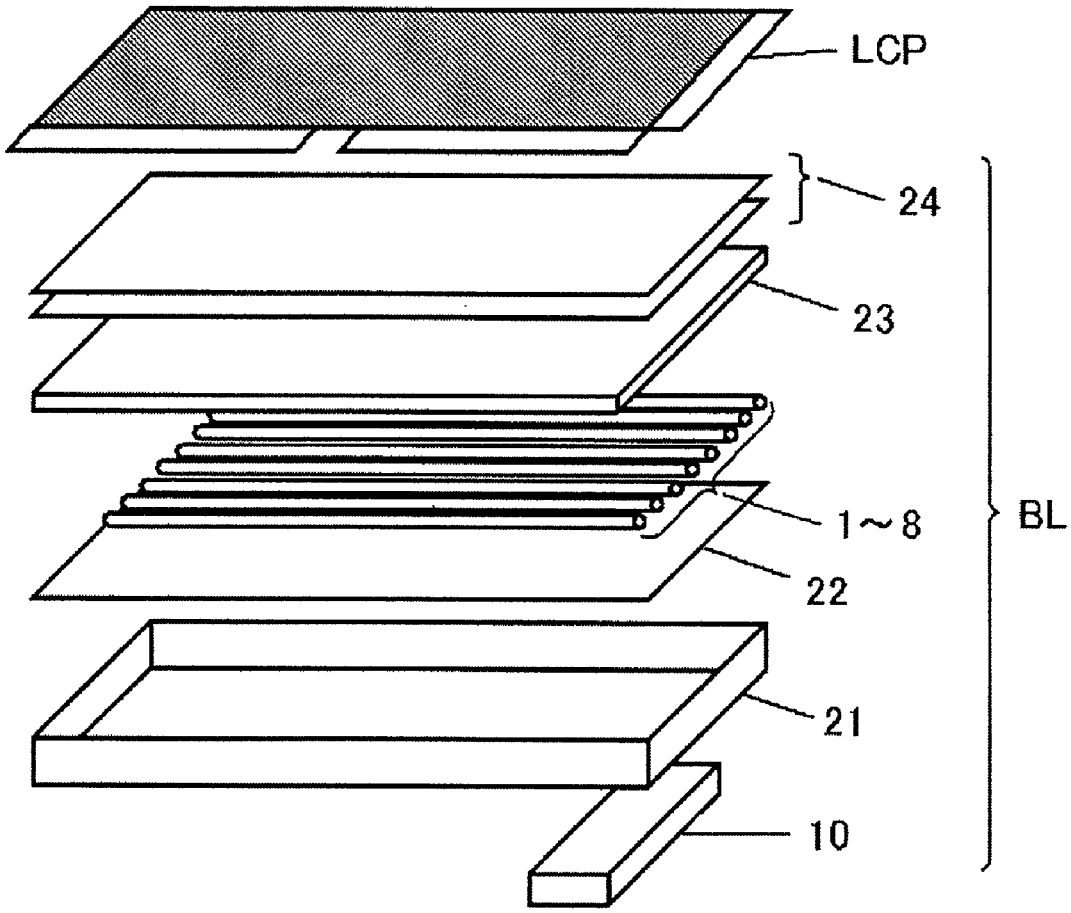
FIG. 9 shows a schematic drawing of a liquid crystal display device according to an embodiment of the present invention.

FIG. 9 shows a schematic drawing of a liquid crystal display device according to an embodiment of the present invention. The backlight BL is disposed (directly) on the rear surface of a liquid crystal panel LCP. The backlight BL comprises a housing 21, a reflector plate 22 disposed above the housing 21, discharge lamps 1 to 8 which are disposed above the reflector plate 22, a diffuser plate 23 which is disposed above the discharge lamps 1 to 8, and one or a plurality of optical sheets 24, such as a prism sheet, which is disposed above the diffuser plate 23.

Moreover, a discharge lamp operating device 10 which lights up the discharge lamps 1 to 8 is provided on the rear surface of the housing 21. For the discharge lamp operating device 10, it is possible to employ the discharge lamp operating device according to any one of the first to fourth embodiments. The reflector plate 22 directs the light of the discharge lamps 1 to 8 toward the front surface. The diffuser plate 23 diffuses the light from the discharge lamps 1 to 8 and the reflector plate 22, thereby averaging out the luminosity distribution of the illumination light on the front surface.

According to the liquid crystal display device of the present embodiment, the liquid crystals in each of the pixels of the liquid crystal panel LCP are driven in accordance with a video signal, thereby transmitting the light radiated from the backlight BL and causing an image to be displayed on the liquid crystal panel LCP.

The discharge lamp operating devices described in the first to fourth embodiments may also be employed in an illumination device. An overall schematic drawing of the illumination device would be similar to the overall schematic drawing of the discharge lamp operating devices according to the first to fourth embodiments, and therefore is not depicted here.

SUMMARY OF THE PRESENT INVENTION (1) The discharge lamp operating device according to the present invention is a discharge lamp operating device which operates a discharge lamp having a filament, characterized in comprising: an inverter circuit which converts an output from a DC power source unit to a high-frequency output and supplies the output to the discharge lamp; a filament preheating circuit comprising a preheating winding for supplying a preheating current to the filament and a preheating capacitor connected between the preheating winding and the filament; a series circuit comprising a serially connected rectifying element and resistance, the circuit being connected in parallel to the filament; a detection circuit which detects a DC voltage component of the preheating capacitor; a comparator which compares the output of the detection circuit with a reference voltage; and a control circuit which receives the output of the comparator and limits the output of the inverter circuit or halts the operation of the inverter circuit.

According to this composition, since a series circuit comprising a diode and a resistance is connected in parallel to the filament, and the preheating capacitor detects the DC voltage component, then it is possible to detect disconnection of the filament by means of a simple composition, without needing to provide a DC power source unit separately on the secondary side.

Furthermore, since there is no need for a resistance for passing a DC current from the DC power source unit to the filaments, as indicated in Patent Document 2, then it is possible to reduce the number of components, and it is also possible to detect disconnection of the filaments in a stable fashion.

(2) Furthermore, in the composition described above, desirably, the detection circuit detects a DC voltage component of the voltage of at least one end of the filament.

According to this composition, it is possible to detect disconnection of the filament by detecting the DC voltage component of the voltage of at least one end of the filament.

(3) Furthermore, desirably, in the composition described above, the detection circuit comprises a first detection circuit which is connected to one end of the filament, and a second detection circuit which is connected to the other end of the filament; and the comparator takes the detected voltage of one of the first and second detection circuits, as a reference voltage, and compares the respective detected voltages of the first and second detection circuits.

According to this composition, since the DC voltage components of the voltages at either end of the filament are respectively detected and compared, then it is possible reliably to detect disconnection of the filament or connection defects of the discharge lamp, irrespectively of the rectifying effect at the end of the lifespan of the discharge lamp.

(4) Desirably, when R represents the resistance value of the resistance connected in series with the rectifying element and Rh represents the hot resistance of the filament, then R>Rh.

According to this composition, it is possible to increase the difference in the DC voltage component appearing at the preheating capacitor, between normal operation and abnormal operation of the filament, and hence it is possible to increase the accuracy of detection of abnormality of the filament.

(5) Desirably, the inverter circuit comprises a transformer in which the DC power source unit side is taken as a primary side and the discharge lamp side is taken as a secondary side.

According to this composition, since the inverter circuit comprises a transformer, it is possible to operate a high-voltage discharge lamp. Therefore, it is possible to operate a thin-tube discharge lamp or a long discharge lamp, and it is easy to increase the surface area and reduce the thickness of an illumination device and a liquid crystal display device.

(6) Desirably, the transformer is an isolation transformer.

According to this composition, since the inverter circuit comprises an isolation transformer, then the DC power source unit and the discharge lamp are isolated from each other, and electric shock can be prevented.

(7) The illumination device according to the present invention is characterized in comprising the discharge lamp operating device according to any one of (1) to (6) above.

According to this composition, it is possible to provide an illumination device which comprises the discharge lamp operating device according to any one of (1) to (6) above.

(8) The liquid crystal display device according to the present invention is characterized in comprising the discharge lamp operating device according to any one of (1) to (6) above.

According to this composition, it is possible to provide a liquid crystal display device which comprises the discharge lamp operating device according to any one of (1) to (6) above.

The invention claimed is:

1. A discharge lamp operating device which operates a discharge lamp having a filament, comprising: an inverter circuit which converts an output from a DC power source unit to a high-frequency output and supplies the output to the discharge lamp;

a filament preheating circuit comprising a preheating winding for supplying a preheating current to the filament and a preheating capacitor connected between the preheating winding and the filament;

a series circuit comprising a rectifying element and resistance, the circuit being connected in parallel to the filament;

a detection circuit which detects a DC voltage component of the preheating capacitor;

a comparator which compares the output of the detection circuit with a reference voltage; and a control circuit which receives the output of the comparator and limits the output of the inverter circuit or halts the operation of the inverter circuit.

2. The discharge lamp operating device according to claim 1, characterized in that the detection circuit detects a DC voltage component of the voltage of at least one end of the filament.

3. The discharge lamp operating device according to claim 1, characterized in that the detection circuit comprises a first detection circuit which is connected to one end of the filament, and a second detection circuit which is connected to the other end of the filament, and the comparator takes the detected voltage of one of the first and second detection circuits, as a reference voltage, and compares the respective detected voltages of the first and second detection circuits.

4. The discharge lamp operating device according to claim 1, characterized in that, when R represents the resistance value of the resistance connected in series to the rectifying element, and Rh represents the hot resistance of the filament to be, then R>Rh.

5. The discharge lamp operating device according to claim 1, characterized in that the inverter circuit comprises a transformer in which the DC power source unit side is a primary side and the discharge lamp side is a secondary side.

6. The discharge lamp operating device according to claim 5, characterized in that the transformer is an isolation transformer.

7. An illumination device, comprising the discharge lamp operating device according to claim 1.

8. A liquid crystal display device, comprising the discharge lamp operating device according to claim 1.

* * * * *